US008555681B2

(12) United States Patent
Caudevilla De sola et al.

(10) Patent No.: US 8,555,681 B2
(45) Date of Patent: Oct. 15, 2013

(54) COVER FOR AN INSPECTION GLASS OF A WASHER AND/OR DRYER DOOR, WASHER AND/OR DRYER DOOR COMPRISING A COVER FOR AN INSPECTION GLASS, AND WASHER AND/OR DRYER COMPRISING A DOOR THAT HAS A COVER FOR AN INSPECTION GLASS

(75) Inventors: Angel Caudevilla De sola, Saragossa (ES); Elena Cortes Perez, Saragossa (ES); Carlos Lopez Palacios, Saragossa (ES); Alberto Romeo Carnicero, Saragossa (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 536 days.

(21) Appl. No.: 12/920,485

(22) PCT Filed: Mar. 11, 2009

(86) PCT No.: PCT/EP2009/052841

§ 371 (c)(1), (2), (4) Date: Sep. 1, 2010

(87) PCT Pub. No.: WO2009/112511

PCT Pub. Date: Sep. 17, 2009

(65) Prior Publication Data

US 2011/0006649 A1 Jan. 13, 2011

(30) Foreign Application Priority Data

Mar. 12, 2008 (ES) ..... 200800826

(51) Int. Cl.
*D06F 37/28* (2006.01)

(52) U.S. Cl.
USPC ..... 68/196; 68/3 R; 312/284; 34/601; 34/603

(58) Field of Classification Search
USPC ..... 68/196, 3 R; 312/284; 34/601, 603
See application file for complete search history.

(56) References Cited

U.S. PATENT DOCUMENTS

| | | | | |
|---|---|---|---|---|
| 5,454,615 | A * | 10/1995 | Schnepf | 296/95.1 |
| 6,966,204 | B2 * | 11/2005 | Bollmann | 68/196 |
| 7,299,666 | B2 * | 11/2007 | Geyer et al. | 68/196 |
| 7,934,399 | B2 * | 5/2011 | No et al. | 68/3 R |
| 7,934,404 | B2 * | 5/2011 | Ha | 68/196 |
| 2004/0050117 | A1 | 3/2004 | Geyer et al. | |
| 2007/0125132 | A1 * | 6/2007 | Hwang | 68/3 R |
| 2008/0028804 | A1 | 2/2008 | Hoppe et al. | |
| 2008/0203870 | A1 * | 8/2008 | Riley et al. | 312/265.6 |

FOREIGN PATENT DOCUMENTS

| | | | |
|---|---|---|---|
| DE | 19515040 | A1 * | 10/1996 |
| DE | 19515040 | C2 | 9/1999 |
| EP | 343151 | A2 * | 11/1989 |
| EP | 1334228 | B1 | 10/2001 |

(Continued)

*Primary Examiner* — Michael Barr
*Assistant Examiner* — Kevin G Lee
(74) *Attorney, Agent, or Firm* — James E. Howard; Andre Pallapies

(57) ABSTRACT

A door of a washer and/or a dryer, the door including a frame to hinge the door to a machine housing of the washer and/or dryer, an inspection glass, and a cover for the inspection glass, wherein the cover has two essentially opposite main sides and an outer circumferential zone. Smooth conical surfaces of the cover and of the frame are in contact with one another to hold the cover in the frame, and the circumferential zone tapers in an area of a contact surface towards the frame.

9 Claims, 1 Drawing Sheet

(56) References Cited

FOREIGN PATENT DOCUMENTS

| | | | | |
|---|---|---|---|---|
| EP | 1762650 | A3 | | 8/2006 |
| JP | 2005152419 | A | * | 6/2005 |
| KR | 2004011219 | A | * | 2/2004 |
| KR | 2005022092 | A | * | 3/2005 |

* cited by examiner

COVER FOR AN INSPECTION GLASS OF A WASHER AND/OR DRYER DOOR, WASHER AND/OR DRYER DOOR COMPRISING A COVER FOR AN INSPECTION GLASS, AND WASHER AND/OR DRYER COMPRISING A DOOR THAT HAS A COVER FOR AN INSPECTION GLASS

BACKGROUND OF THE INVENTION

The invention relates to washer and/or dryer door, having a frame by way of which said door can be hinged to a machine housing of the washer and/or dryer, and having an inspection glass and a cover for the inspection glass, whereby smooth surfaces of the cover and of the frame are in contact with one another in order to hold the cover in the frame, and whereby the cover has two main sides and an outer circumferential zone, whereby the main sides are essentially situated opposite one another, and a washer and/or dryer door having a machine housing and such door.

Such a door and such a washer and/or dryer are disclosed in DE 195 15 040 A1.

Washers and/or dryers have a door having a porthole or inspection glass. The door is normally hinged to the machine housing by way of a frame, whereby the frame has the inspection glass. The inspection glass is provided with a cover preventing access because the inspection glass can heat up during operation to temperatures in excess of 60° Celsius. The cover is normally arranged between the components of the frame and is screwed, riveted, stuck or the like to the frame. By this means, the cover is held securely in the frame or clamped between the components thereof. A disadvantage in this situation is the fact that an exchange or replacement of the cover is made difficult or impossible.

DE 195 15 040 C2 discloses a porthole door for a front loading drum washing machine having an inspection glass. The inspection glass is inserted in a frame, which is hinged on the housing, from the inside of the drum and drawn in a pot-shaped fashion in the direction of the drum interior. The inspection glass is provided with a cover preventing access to the inspection glass approximately in the plane of an outer diaphragm ring of the frame. The frame encompasses the edge of the cover at the side and on the front outside. The edge of the cover is secured between the diaphragm ring and the inspection glass in the frame. The frame has a holding ring which surrounds the edge of the cover with a small degree of clearance.

EP 1 334 228 B1 discloses a porthole door for a front loading drum washing machine. A frame comprising a support ring and holding ring is hinged on the washing machine housing. The door furthermore has an inspection glass which is drawn in pot-shaped fashion in the direction of the drum interior and is protected by a cover preventing access approximately in the plane of outer holding ring of the frame. The edge of the cover is secured on the frame. The cover is enclosed on its narrow shell side by the holding ring. The cover consists of a piece of flat glass cooled over a molding die.

EP 1 762 650 A2 discloses a porthole door for a front loading laundry treatment machine, which door comprises an inspection glass having a frame and an essentially transparent viewing glass. The frame which carries the inspection glass contains a diaphragm ring and an inner ring. The viewing glass is connected to the diaphragm ring, by which means a one-piece part is provided, whereby the viewing glass covers the diaphragm ring on the front side.

A washing machine door having a conventional mounting structure for a cover is shown in FIG. 3 and FIG. 4.

FIG. 3 shows a part of a sectional representation of a door 10 of a washer and/or dryer according to the prior art. The door 10 can be hinged in a known manner at the side at a loading opening. The door 10 has an inspection glass 12 and a frame 14. The inspection glass 12 is designed to be essentially pot-shaped and is designed with a flange-shaped edge 16. The frame 14 has a diaphragm ring 18 with a holding ring 20, and a mounting ring 22. The flange-shaped edge 16 of the inspection glass 12 is arranged between the holding ring 20 and the mounting ring 22 such that the inspection glass 12 is clamped in the region of the edge 16 between the diaphragm ring 18 and the mounting ring 22 by way of the holding ring 20.

Furthermore, a gap 24 which essentially extends in a radial direction of the inspection glass 12 is provided between the holding ring 20 and the diaphragm ring 8. A cover 26 can be inserted into the gap 24, as can be seen from FIG. 1. The cover 26 can be made of silicate glass or a plastic, whereby it can be transparent, clear or tinted, or completely opaque. The cover 26 serves primarily as protection for operating persons to prevent access to the inspection glass 12 which can heat up unpleasantly or dangerously during operation of the washer and/or dryer with temperatures in excess of 60° Celsius. The cover 26 is moreover suitable as a decorative object which can be configured according to requirements for example by designers.

FIG. 4 essentially corresponds to the illustration in FIG. 3, whereby the cover 26 is removed. As can be seen from the illustration, the gap 24 is exposed. This means that objects such as for example dirt and dust can accumulate in the gap 24. Since the cover 26 is relatively thin, the gap 24 is accordingly dimensioned to be spatially restricted. Fingers of a human hand can normally not reach or be inserted into the gap 24. The gap 24 is therefore almost inaccessible for cleaning purposes. When the cover 26 is removed, this gap 24 is also unacceptable from an aesthetic perspective because such a gap 24 is generally regarded as visually disturbing by the consumer.

The aforementioned doors cannot be used or are not used without the cover because they would otherwise exhibit a gap or slot between the frame and the inspection glass. Such a gap or slot is unacceptable from an aesthetic perspective. Furthermore dirt, such as dust for example, can accumulate there, which on account of an inadequate access capability can only be removed with difficulty or cannot be removed at all.

BRIEF SUMMARY OF THE INVENTION

An object of the invention is therefore to set down a door having a cover for an inspection glass, whereby the cover can be simply, in other words with as few work steps as possible, mounted on the door as a separate component and the door should be designed such when used without the cover that no dirt or similar can accumulate at the location at which the cover were to be mounted.

A washer and/or dryer having a machine housing and such a door is also to be specified.

This object is achieved by a door of a washer and/or dryer and a washer and/or dryer in accordance with the respective independent claim.

The invention is based on the idea of designing a cover for an inspection glass as an optional component for a door of a washer and/or dryer and the corresponding door of a washer and/or dryer such that, if the cover is not mounted, no gap or similar free space is formed in or on the frame, in which dirt or the like can accumulate and is disadvantageous from an aesthetic perspective, with the result that the same frame can always be used. In particular, the cover is designed in such a manner that on account of the special shaping it is held operatively connected to a correspondingly designed area or section of a frame of the door. This is achieved by the fact that smooth surfaces of an area of the cover and of the frame are brought into contact with one another which are designed to be sloping relative to a main plane of the cover or of the frame and thus form a conical or tapering contact surface. This means that the cover can only be introduced from one side, in other words in a predefined direction of introduction, and is held from this main side by a component such that it cannot come loose. At the same time, no grooves or undercuts into which the cover is inserted are required.

According to the invention the cover has two main sides, or main surfaces, and an outer circumferential zone. The outer circumferential zone tapers in an area of a contact surface. The cover is designed so as to be held against the frame or the door when the contact surface makes contact with a complementarily, in other words correspondingly oppositely tapering, designed area of a frame of the door.

By preference, the main sides are essentially situated opposite one another and an angle is formed between one of the main sides and the outer circumferential zone which is less than 90°, in other words imaginary extension lines or surfaces of the main sides and of the circumferential zone intersect at an angle which is less than 90°, with the result that the circumferential zone tapers overall in a direction which when the cover is in a mounted state extends away from the inspection glass.

By preference, the outer circumferential zone has a chamfer, such that the cover when mounted on a frame of a door of a washer and/or dryer can be held particularly well solely on the basis of its particular shape if the frame has a correspondingly complementary shape.

By preference, the outer circumferential zone is designed to project with respect to at least one of the main sides, by which means an area on which the cover can be held by a frame of a door of a washer and/or dryer is enlarged.

By preference, the main sides are designed to be circular, with the result that the circumferential zone is conical, or rectangular.

By preference, the cover is made of silicate glass or plastic, clear or tinted or opaque, by which means a wide variety of design options is given for the cover.

By preference, a door of a washer and/or dryer has an inspection glass and a frame, whereby the frame has an area which is designed such that the frame is shaped so as to hold the cover through contact of a contact surface of one of the aforementioned covers with the area of the frame.

By preference, the frame has a diaphragm ring and a mounting ring, between which the inspection glass is mounted, by which means the inspection glass is held securely.

By preference, the diaphragm ring is designed to be complementary to the contact surface of the cover at an inner circumferential zone, by which means the cover can be easily mounted and is held on the frame only by the particular shapes of the contact surfaces.

By preference, the inner circumferential zone has a chamfer which is adapted to hold the cover in contact with the inspection glass, by which means a gap is prevented from forming between the diaphragm ring and the inspection glass when the cover is removed.

By preference, the chamfer of the diaphragm ring tapers in a direction which is opposite to the inspection glass, by which means the cover can be held particularly well.

By preference, the inspection glass is mounted such between the diaphragm ring and the mounting ring that only an area of one edge of the inspection glass is provided for making contact with the cover, by which means only a small area is formed on which dirt can accumulate when the cover is removed.

By preference, a washer and/or dryer has a door having an inspection glass which can be covered by an aforementioned cover.

Advantageous embodiments of the cover according to the invention, of the door and of the washer and/or dryer are the subject matter of the respectively associated dependent claims which are supported in the following description and the drawings.

BRIEF DESCRIPTION OF THE DRAWINGS

Further features of the invention will emerge from the exemplary description of an embodiment of the invention with reference to the figures.

DETAILED DESCRIPTION OF EXEMPLARY EMBODIMENTS OF THE PRESENT INVENTION

Figure 1:
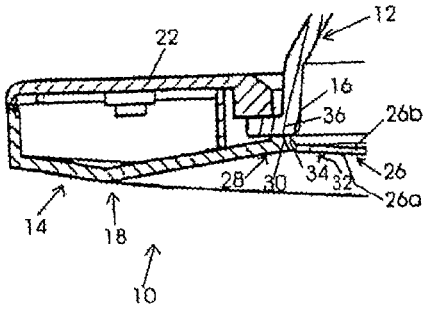
FIG. 1 shows a part of a sectional representation of a door according to the invention of a washer and/or dryer having a cover.
Figure 3:
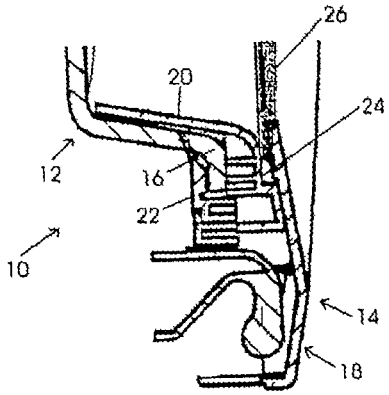
Prior Art FIG. 3
FIG. 3 shows a part of a sectional representation of a door of a washer and/or dryer having a cover according to the prior art.
Figure 4:
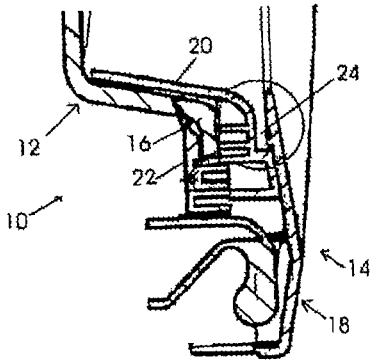
Prior Art FIG. 4
FIG. 4 shows a part of a sectional representation of a door of a washer and/or dryer, whereby the cover is removed.

FIG. 1 shows a part of a sectional representation of a door 10 of a washer and/or dryer according to the invention. It should be noted that components which correspond to those of the door according to the prior art described in the introduction in conjunction with FIG. 3 and FIG. 4 are denoted by the same reference characters. The door 10 according to the invention has a frame 14 and a pot-shaped inspection glass 12. The inspection glass 12 has an edge 16 with a flange-shaped design. The frame 14 has a diaphragm ring 18 and a mounting ring 22. The flange-shaped edge 16 of the inspection glass 12 is clamped between the diaphragm ring 18 and the mounting ring 22, whereby the diaphragm ring 18 rests against the edge 16.

In its inner circumferential zone 28 viewed in the radial direction the diaphragm ring 18 has a chamfer 30. The chamfer 30 is designed such that it tapers in a direction which is opposite to the pot-shaped depression of the inspection glass 12.

A cover 26 is also provided with regard to the door 10 according to the invention. The cover 26 has two main sides **26*a*, 26*b* situated essentially parallel opposite each another. Their outer circumferential zone 32 tapers in an area of a contact surface 34. In a state in which the cover 26 is mounted on the frame 14, the cover 26 rests with the contact surface 34 against the inner circumferential zone 28 or the chamfer 30 of the diaphragm ring 18 and against a relatively small inner circumferential zone 36 of the edge 16 of the inspection glass 12, as illustrated in FIG. 1. More precisely, the outer circumferential zone 32** is inclined with respect to the main sides

26*a*, 26*b*, in other words the circumferential zone 32 is not perpendicular with respect to the main sides 26*a*, 26*b*. In particular, the outer circumferential zone 32 has a chamfer 38 which is designed to be complementary to the chamfer 30. An angle which is formed between the outer circumferential zone 32 or the chamfer 38 and the main side 26*b* is therefore less than 90° and the outer circumferential zone 32 tapers overall in an area of the contact surface 34 in a direction which extends away from the inspection glass 12. Overall, the cover 26 thereby generally exhibits the shape of a truncated cone.

In order to mount the cover 26 on the door 10 the cover 26 is simply pushed into the diaphragm ring 18, with the result that a type of press fit is formed between the diaphragm ring 18 and the cover 26. The cover 26 is held by the shape of the chamfer 30 of the diaphragm ring 18 without fixing means, such as screws, rivets, adhesive or the like.

Figure 2:
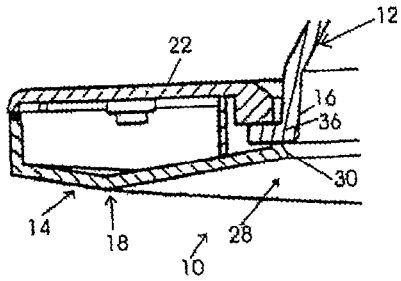
FIG. 2 shows a part of a sectional representation of a door of a washer and/or dryer, whereby the cover is removed.

FIG. 2 corresponds essentially to the representation shown in FIG. 1, whereby the cover 26 is removed. As can be seen from the illustration, only the relatively small inner circumferential zone 36 of the edge 16 of the inspection glass 12 projects beyond the diaphragm ring 18, against which the cover 26 would otherwise rest. A gap such as is present in the case of the above door according to the prior art is however no longer given by the arrangement according to the invention. This means that this small inner circumferential zone 36 of the edge 16 is accessible for cleaning purposes, with the result that possible deposits of dust or the like can be easily removed. Furthermore, thanks to the special design, the possibility exists to exchange the cover 26. To this end a tool may be required which is inserted between the two chamfers and the cover 26 is then pushed out by means of a lever movement.

Thanks to the special shaping of the frame and of the cover it is for example possible to use or manufacture doors always having one and the same frame for a washer and/or dryer, regardless of whether a cover is to be mounted, without having to accept decorative or aesthetic and cleaning related disadvantages.

In this situation, the form of the chamfer is not restricted to a type of linear rim, as can be seen in the figures. The form can be chosen as required. In particular, a form rounded, curved, waved, provided with grooves or dimples is conceivable. The outer circumferential zone can be formed by at least one of the main sides projecting. Generally, when viewed from above, the cover can be circular or disk-shaped, square, rectangular trapezoidal or convex.

LIST OF REFERENCE CHARACTERS

10 Door
12 Inspection glass
14 Frame
16 Edge
18 Diaphragm ring
20 Holding ring
22 Mounting ring
24 Gap
26 Cover
26*a* Main side
26*b* Main side
28 Inner circumferential zone
30 Chamfer
32 Outer circumferential zone
34 Contact surface
36 Inner circumferential zone
38 Chamfer

The invention claimed is:

1. A door of at least one of a washer and a dryer, the door comprising:
- a frame to hinge the door to a machine housing of the at least one of the washer and the dryer, the frame having a mounting ring and a diaphragm ring;
- an inspection glass; and
- a cover for the inspection glass, the cover having two opposing main sides and an outer circumferential zone;
- wherein smooth conical surfaces of the cover and of the frame are in contact with one another to hold the cover in the frame;
- wherein the outer circumferential zone is chamfered along a contact surface towards the frame; and
- wherein the cover, diaphragm ring and inspection glass are in mutual contact at a common point.

2. The door of claim 1, wherein an angle of less than 90° is formed between a plane of one of the two main sides of the cover and the outer circumferential zone of the cover.

3. The door of claim 2, wherein the outer circumferential zone projects outwardly with respect to at least one of the two main sides.

4. The door of claim 2, wherein the two main sides are one of circular and rectangular.

5. The door of claim 1, wherein the cover is made of one of silicate glass and plastic.

6. The door of claim 5, wherein the cover is one of clear, tinted and opaque.

7. The door of claim 1, wherein the inspection glass is mounted between the diaphragm ring and the mounting ring.

8. The door of claim 7, wherein the inspection glass includes a pot-shaped depression having a flange-shaped edge, and wherein the cover abuts the diaphragm ring and the inspection glass, and wherein the inspection glass is held with the flange-shaped edge extending between the mounting ring on one side of the flange-shaped edge, and the diaphragm ring and the cover on an opposing side of the flange-shaped edge, and wherein removal of the cover exposes a first portion of the flange-shaped edge for cleaning access, with the inspection glass remaining in place with a second portion of the flange-shaped edge being held between the mounting ring and the diaphragm ring.

9. An appliance, comprising:
- a machine housing; and
- a door, the door comprising:
  - a frame to hinge the door to the machine housing, the frame having a mounting ring and a diaphragm ring;
- an inspection glass; and
- a cover for the inspection glass, the cover having two opposing main sides and an outer circumferential zone;
  - wherein smooth conical surfaces of the cover and of the frame are in contact with one another in order to hold the cover in the frame;
  - wherein the outer circumferential zone is chamfered along a contact surface towards the frame;
  - wherein the cover, diaphragm ring and inspection glass are in mutual contact at a common point; and
  - wherein the appliance is at least one of a washer and a dryer.

* * * * *